US009073610B2

(12) United States Patent
Seo

(10) Patent No.: US 9,073,610 B2
(45) Date of Patent: Jul. 7, 2015

(54) TURRET DEVICE

(75) Inventor: Young Hak Seo, Geoje-si (KR)

(73) Assignee: SAMSUNG HEAVY IND. CO., LTD (KR)

( * ) Notice: Subject to any disclaimer, the term of this patent is extended or adjusted under 35 U.S.C. 154(b) by 25 days.

(21) Appl. No.: 14/000,396

(22) PCT Filed: Oct. 11, 2011

(86) PCT No.: PCT/KR2011/007549

§ 371 (c)(1), (2), (4) Date: Aug. 19, 2013

(87) PCT Pub. No.: WO2012/115322

PCT Pub. Date: Aug. 30, 2012

(65) Prior Publication Data

US 2014/0123889 A1 May 8, 2014

(30) Foreign Application Priority Data

Feb. 25, 2011 (KR) ..... 10-2011-0017142

(51) Int. Cl.
*B63B 43/16* (2006.01)
*B63B 21/50* (2006.01)

(52) U.S. Cl.
CPC ..... *B63B 21/507* (2013.01)

(58) Field of Classification Search
CPC ..... B63B 21/507
USPC ..... 114/230.1, 230.12
See application file for complete search history.

(56) References Cited

U.S. PATENT DOCUMENTS

| | | | | |
|---|---|---|---|---|
| 5,240,446 | A * | 8/1993 | Boatman et al. | 441/3 |
| 5,292,271 | A * | 3/1994 | Boatman et al. | 441/3 |
| 5,316,509 | A * | 5/1994 | Boatman et al. | 441/3 |
| 5,346,314 | A * | 9/1994 | Perratone et al. | 384/97 |
| 5,372,531 | A * | 12/1994 | Boatman et al. | 441/4 |
| 5,762,017 | A * | 6/1998 | Groves | 114/230.12 |
| 7,347,156 | B2 * | 3/2008 | Lindblade | 114/230.12 |
| 8,770,128 | B2 * | 7/2014 | Dupont et al. | 114/230.12 |
| 2002/0073906 | A1 | 6/2002 | Hobdy et al. | |
| 2002/0124788 | A1 | 9/2002 | Hobdy | |
| 2004/0055522 | A1 | 3/2004 | Boatman et al. | |

* cited by examiner

*Primary Examiner* — Daniel V Venne

(57) ABSTRACT

Disclosed is a turret device. The turret device according to one embodiment of the present invention includes an upper turret installed in a vertical opening which penetrates a hull; and a lower turret which is coupled to the bottom of the upper turret and has a lower bearing assembly which supports the hull to allow rotation, wherein a lower bearing is arranged on the outer surface of the lower turret; and an independent sliding pad is coupled to the inner surface of the hull forming the vertical opening, and slidably contacts the lower bearing in the shape of a plate.

9 Claims, 3 Drawing Sheets

TURRET DEVICE

TECHNICAL FIELD

The present invention relates to a turret device, and more particularly, to a turret device installed in a vertical opening of a vessel to moor the vessel to allow the vessel to relatively rotate.

BACKGROUND ART

A drill ship or a liquefied natural gas-floating production storage and offloading (LNG-FPSO) for drilling of gas or oil in a seabed includes a turret to assist the drilling. The turret is often installed in a vertical opening or a moon pool provided at one end, typically the bow, of a vessel, and is moored by being fixed to a subsea well platform by chains or the like.

Also, the turret is installed in a vessel to allow the vessel to relatively rotate around a center axis of the turret and to provide a stable and continuous transfer path of gas or oil from the subsea well platform to the vessel during a drilling operation. In other words, even when a vessel on a sea surface is moved by wind, waves, or tides during transferring gas or oil, the vessel may freely rotate around the fixed turret as a center axis. Accordingly, the gas or oil may be stably transferred through a tube inside the fixed turret regardless of the movements of the vessel.

In a structure to allow the vessel to rotate around the turret, for example, a bearing provided on the turret slidably contacts an inner wall of a hull forming a vertical opening. In this case, the inner wall of a hull contacting the bearing requires strength enough to endure a horizontal load applied during the sliding with the turret.

To satisfy the required strength, conventionally, Inconel welling is performed on the entire surface of the inner wall of a hull that contacts the bearing and a bearing contact surface is formed through a grinding process. However, such a conventional method is disadvantageous because of an excessive welling work to form an Inconel welling bead, defective welding precision according thereto, and difficulty in mechanical processing, by which a considerable work time is consumed and production efficiency is deteriorated.

DETAILED DESCRIPTION OF THE INVENTION

Technical Problem

The present invention provides a turret device which is manufactured with much reduced number of welding steps so that a work time is reduced, and has a smooth contact surface with a bearing so that sliding with respect to a hull may be smoothly performed.

Technical Solution

According to an aspect of the present invention, there is provided a turret device including an upper turret installed in a vertical opening that penetrates a hull, and a lower turret coupled to a lower portion of the upper turret and having a lower bearing assembly that supports the hull to allow rotation, in which the lower bearing assembly includes a lower bearing provided on an outer circumferential surface of the lower turret, and an independent sliding pad coupled to an inner wall of the hull forming the vertical opening and slidably contacting the lower bearing.

The independent sliding pad may be provided by connecting a plurality of slit plates and each of the plurality of slit plates may include at least one slit.

The independent sliding pad may further include a bearing contact wall portion that protrudes from the inner wall of the hull forming the vertical opening.

The plurality of slit plates may be manufactured of a material different from a material for the bearing contact wall portion.

A welding portion for combining the bearing contact wall portion and the plurality of slit plates may be formed along edges of the plurality of slit plates and in the slit.

The welding portion may include a first welding layer preventing galvanic corrosion due to hetero-metal contact between the bearing contact wall portion and the plurality of slit plates, and a second welding layer formed on an upper surface of the first welding layer and preventing corrosion by seawater.

The first welding layer may be formed of molybdenum-added stainless steel and the second welding layer may be formed of a stainless steel material.

The lower turret may be connected to the upper turret and may expand toward a lower portion of the lower turret so as to have a diameter larger than a diameter of the upper turret.

Advantageous Effects

According to the present invention, the turret device include a sliding pad which is manufactured with reduced welding to the minimum and may prevent deterioration of the production efficiency due to excessive welding work, defective welling precision, and difficulty in mechanical processing.

BEST MODE

Figure 1:
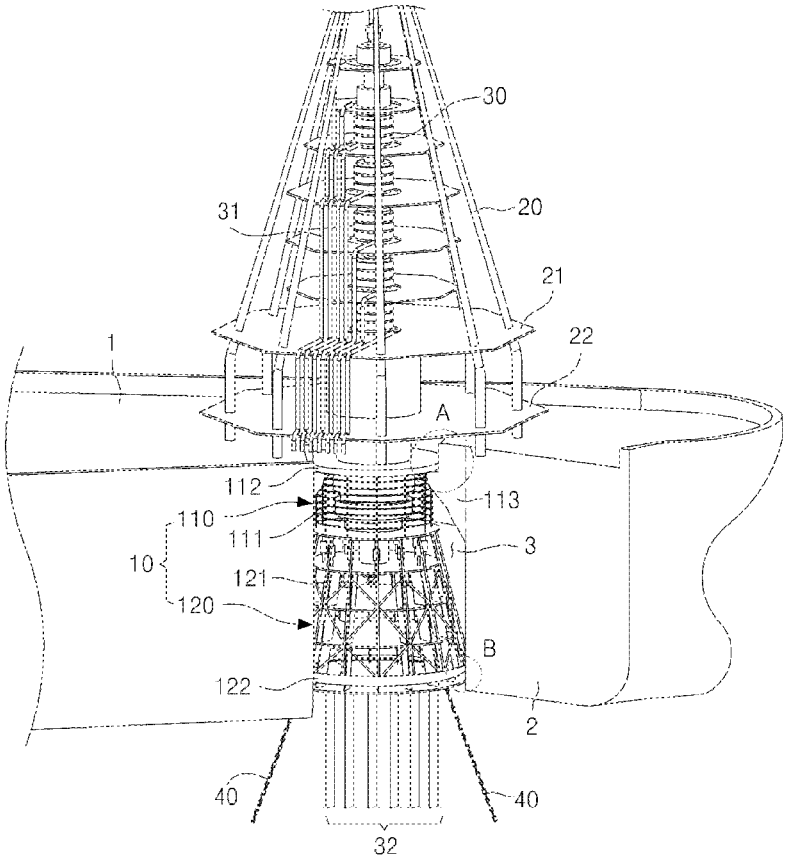
FIG. 1 is a partially cut-away perspective view of the bow of a vessel where a turret device is installed, according to an embodiment of the present invention.

The attached drawings for illustrating exemplary embodiments of the present invention are referred to in order to gain a sufficient understanding of the present invention, the merits thereof, and the objectives accomplished by the implementation of the present invention. Hereinafter, the present invention will be described in detail by explaining exemplary embodiments of the invention with reference to the attached drawings. Like reference numerals in the drawings denote like elements.

Figure 2:
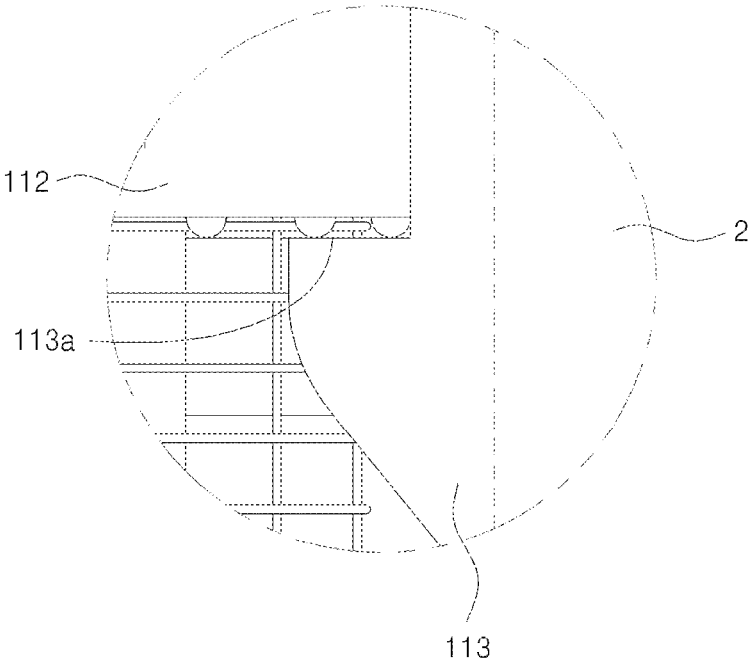
FIG. 2 is an enlarged view of a portion A of an upper turret of FIG. 1.
Figure 3:
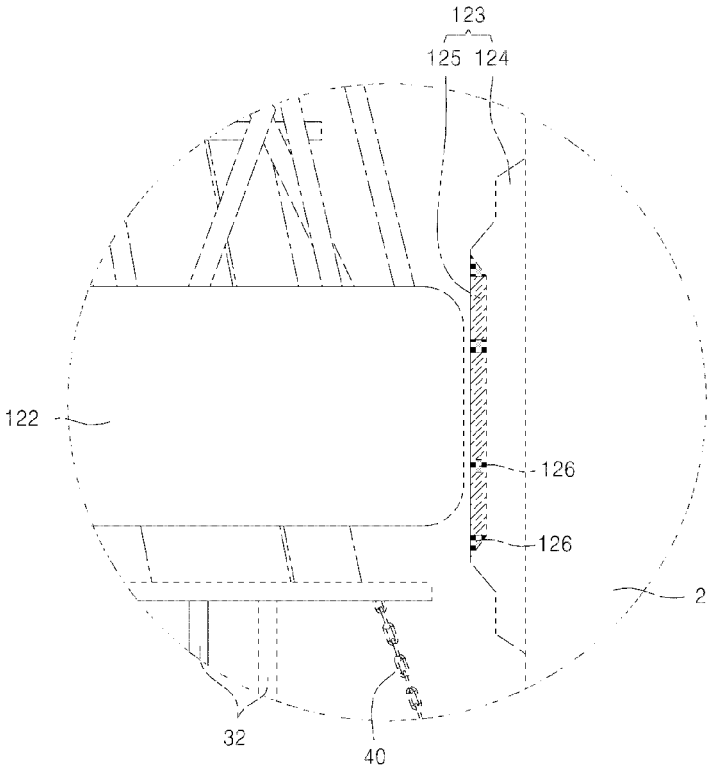
FIG. 3 is an enlarged view of a portion B of a lower turret of FIG. 1.
Figure 4:
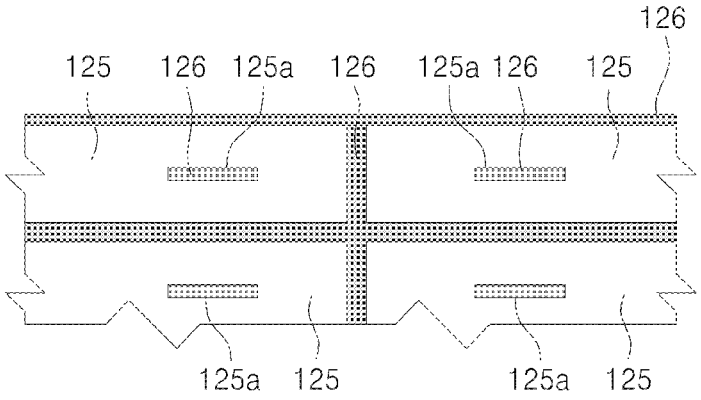
FIG. 4 is a plan view of an independent sliding pad forming a lower bearing assembly.
Figure 5:
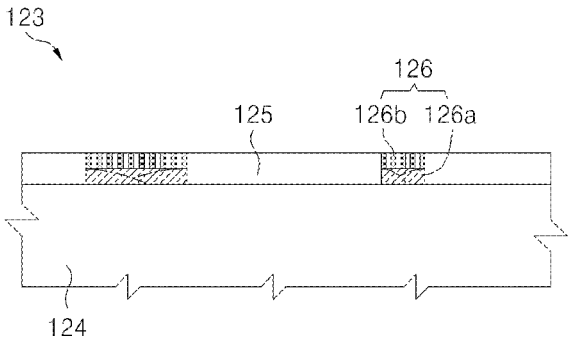
FIG. 5 is a view illustrating a structure of a welling portion of the independent sliding pad.

FIG. 1 is a partially cut-away perspective view of the bow of a vessel where a turret device 10 is installed, according to an embodiment of the present invention. FIG. 2 is an enlarged view of a portion A of an upper turret 110 of FIG. 1. FIG. 3 is an enlarged view of a portion B of a lower turret 120 of FIG. 1. FIG. 4 is a plan view of an independent sliding pad 123 forming a lower bearing assembly (122 and 123). FIG. 5 is a view illustrating a structure of a welling portion 126 of the independent sliding pad 123.

Referring to FIG. 1, the turret device 10 according to the present embodiment may be installed in a vertical opening 3 that penetrates a hull 2 of a vessel 1. The vertical opening 3 may be separately formed in the hull 2 to install the turret device 10 or may be provided by a moon pool for lowering a drill pipe down to the subsea.

The turret device 10 is connected to a subsea well platform (not shown) by a chain 40 to moor the vessel 1 and also coupled to the vessel 2 by means of a bearing structure that allows the hull 2 to rotate around the turret device 10 as a rotational axis.

The vessel 1 may be a drill ship or a liquefied natural gas-floating production storage and offloading (LNG-FPSO). The hull 2 may be moved by wind, waves, or tides while the vessel 1 is engaged on a drilling work or offloading work.

In doing so, the turret device 10 and an inner wall of the hull 2 forming the vertical opening 3 contacting the turret device 10 simultaneously receive an axial load and a horizontal load altogether due to the weight of the turret device 10 and the movement of the hull 2. The turret device 10 according to the present embodiment has a structure to support the loads and allow the vessel 2 to rotate.

Continuously referring to FIG. 1, the turret device 10 according to the present embodiment includes the upper turret 110 installed in the vertical opening 3 that penetrates the hull 2 and the lower turret 120 coupled to a lower portion of the upper turret 110 and having the lower bearing assembly (122 and 123) that supports the hull 2 to allow rotation.

Prior to descriptions about the upper turret 110 and the lower turret 120, structures that are installed above and inside the turret device 10 according to the present embodiment to assist drilling and offloading of gas or oil will be briefly described.

A gantry crane 20, a piping deck 22 forming a lower support body of the gantry crane 20, and a mezzanine deck 21 are installed above the upper turret 110. The gantry crane 20 is used to offload collected gas or raw oil. A swivel stack 30 and a utility pipe connected to the swivel stack 30 may be installed inside a support structure of the gantry crane 20. The utility pipe 31 is supported by the piping deck 22 and the mezzanine deck 21 and guided into the vessel 1.

The swivel stack 30 is fixedly coupled to the upper turret 110. Since the utility pipe 31 connected to the swivel stack 30 includes a rotary body that rotates altogether according to the rotation of the vessel 1, the utility pipe 31 is prevented from being damaged by the rotation of the vessel 1.

The utility pipe 31 is connected to a rising tube 32 installed in the turret device 10. The rising tube 32 is connected to the subsea well platform and thus the gas or raw oil collected from subsea wells is transferred to the utility pipe 31 through the rising tube 32.

The rising tube 32 may be a flexible tube. Although the turret device 10 is fixed to the subsea well platform, the turret device 10 may be moved by currents or waves to a degree, which prevents the rising tube 32 from being damaged by the movement of the turret device 10.

The upper turret 110 mainly supports an axial load applied to the turret device 10 and also supports the vessel 1 to rotate around the turret device 10 as an axis.

Referring to FIGS. 1 and 2 altogether, the upper turret 110 includes an upper turret support 111 and an upper bearing assembly (112 and 113) connected to the upper turret support 111. The upper turret support 111 has a cylindrical shape and is slidably connected to the hull 2 by the upper bearing assembly (112 and 113). The upper bearing assembly (112 and 113) includes a bearing support member 113 connected to the hull 2 and an upper bearing 112 sliding on the bearing support member 113 and fixedly coupled to the upper turret support 111.

The bearing support member 113 protrudes from an inner surface forming the vertical opening 3 at an upper portion of the hull 2. Accordingly, the outer diameter of the upper turret support 111 sliding on the bearing support member 113 may be smaller than that of a lower turret support 121. Although, in the present embodiment, the bearing support member 113 is described as a separate member coupled to the hull 2, the bearing support member 113 may be integrally formed with the hull 2.

A bearing support step 113*a* (see FIG. 2) for supporting the upper bearing 112 is formed on the bearing support member 113. The bearing support step 113*a* protrudes to the inside of the vertical opening 3 and a horizontal surface that the upper bearing 112 contacts is formed in an upper portion of the bearing support step 113*a*.

The upper bearing 112 may be a thrust bearing. Although FIG. 2 illustrates an example of a general thrust bearing, the present invention is not limited thereto and other types of bearings capable of rotating while supporting the axial load may be employed.

In addition, although the upper bearing assembly (112 and 113) mainly supports the axial load applied to the turret device 10, the upper bearing assembly (112 and 113) may also support a horizontal load to assist the lower bearing assembly (122 and 123) that will be described below.

The lower turret 120 is connected to the lower portion of the upper turret 110. Referring to FIGS. 1 and 3 to 5, the lower turret 120 includes the lower turret support 121 and the lower bearing assembly (122 and 123) connected to the lower turret support 121. The lower turret support 121 is connected to the upper turret support 111 and has a shape that gradually increases toward a lower portion compared to the upper turret support 111, that is, roughly a conic shape.

Forming the outer diameter of the lower turret support 121 to be larger than that of the upper turret support 111 is to distribute and support the horizontal load applied to the turret device 10 at its maximum. In other words, when the outer diameter of the lower turret support 121 is increased, a contact area between the lower bearing 122 coupled to the lower turret support 121 and the independent sliding pad 123 coupled to the hull 2 is increased so that the amount of a load to support per unit area decreases. Accordingly, a design limitation range may be expanded, for example, the independent sliding pad 123 may be formed of a relatively soft material.

Referring to FIG. 3, the lower bearing assembly (122 and 123) for supporting the horizontal load applied to the turret device 10 and allowing the hull 2 to rotate includes the lower bearing 122 coupled to the lower turret support 121 and the independent sliding pad 123 that the lower bearing 122 slidably contacts.

The lower bearing 122 is fixedly coupled to the lower portion of the lower turret support 12 where the outer diameter is the maximum. Either a rolling bearing or a sliding bearing may be used as the lower bearing 122. For a sliding bearing, the lower bearing 122 may be formed of a material softer than that of the independent sliding pad 123 for lubrication.

The independent sliding pad 123 includes a bearing contact wall portion 124 coupled to and along the inner wall of the hull 2 of the vertical opening 3 and a plurality of slit plates 125 coupled to the bearing contact wall portion 124 by welding.

Although in the present embodiment the bearing contact wall portion 124 is coupled to the hull 2, the bearing contact wall portion 124 and the hull 2 may be integrally formed.

The bearing contact wall portion 124 has a predetermined thickness and is coupled to the inner wall of the hull 2 of the vertical opening 3 having a cylindrical shape. In addition, a groove for accommodating the slit plates 125 may be formed to have a width corresponding to the width of the slide plates 125 in a surface of the bearing contact wall portion 124 to which the slit plates 125 are coupled.

As the bearing contact wall portion 124 is coupled to the hull 2, a bearing contact surface of the independent sliding pad 123 protrudes inwardly from the hull 2. Accordingly, the lower bearing 122 rotates by first contacting the independent sliding pad 123 when the horizontal load is applied to the turret device 10. Thus, the hull 2 or the lower bearing 122 is prevented from being damaged as the lower bearing 122 first contacts the hull 2, not the independent sliding pad 123.

The bearing contact surface of the independent sliding pad 123 is formed by welding the slit plates 125 to the bearing contact wall portion 124. The slit plates 125 may be connected in a plurality of rows to fit to the width of the bearing contact wall portion 124. As the slit plates 125 are coupled to the entire area of the bearing contact wall portion 124, the bearing contact wall portion 124 may have a circular ring shape after the coupling is completed.

The slit plates 125 may be manufactured of any one of duplex stainless steel, STS316L, and clad steel. The duplex stainless steel exhibits high mechanical strength and superior anti-corrosion so as to be appropriate for the slit slates 125 that supports the turret device 10 under seawater. When clad steel is used for the slit slates 125, a titanium clad steel plate obtained by coating a steel plate with titanium or a stainless-steel clad steel plate obtained by coating a steel plate with stainless steel may be used to improve the anti-corrosion. The clad steel is manufactured by overlapping and rolling a metal plate having superior anti-corrosion and a metal plate having superior mechanical strength.

A slit 125*a* for coupling the slit plates 125 to the bearing contact wall portion 124 by welding is formed at the center portion of the slit plates 125. Since the slit plates 125 are welded to the bearing contact wall portion 124 that is a curved surface, the slit plates 125 need to be deformed to have a curved surface corresponding to the curved shape of the bearing contact wall portion 124 for the welding. In this case, when each of the slit plates 125 is welded to the bearing contact wall portion 124 along only the edges of the slit plates 125, a gap may be generated between the center portion of each of the slit plates 125 and the bearing contact wall portion 124.

To prevent the generation of a gap, when the slit plates 125 are welded to the bearing contact wall portion 124, not only the edges of each of the slit plates 125 but also the slit 125*a* may be welded and thus the slit plates 125 may be firmly welded to the bearing contact wall portion 124 by being deformed corresponding to the curved shape of the bearing contact wall portion 124 without a gap therebetween.

When the independent sliding pad 123 is manufactured in the above method, a welding area is remarkably reduced compared to the conventional method in which the Inconel welding is performed on the entire surface of the inner wall of the hull 2 of the vertical opening 3 to form a contact surface of the lower bearing 122. Accordingly, a welding time and a welding defect check time are reduced so that a work time may be reduced.

The welding portion 126 formed in the slit 125 and at the edges of the slit plates 125 is formed by welding of a dual layer. In other words, the welding portion 126 include a first welding layer 126*a* contacting the bearing contact wall portion 124 and the slit plates 125 and a second welding layer 126*b* welded to an upper portion of the first welding layer 126*a*.

The first welding layer 126*a* is formed of a welding material for improving crack stability according to a hetero-metal welding between the bearing contact wall portion 124 and the slit plates 125. For example, the first welding layer 126*a* may be formed of molybdenum-added stainless steel. The molybdenum-added stainless steel may improve crack stability and prevent galvanic corrosion due to hetero-metal contact. The galvanic corrosion is a phenomenon in which, when a battery is configured with a metal member having a low corrosion electric potential as an anode and a metal member having a high corrosion electric potential as a cathode, corrosion of the metal member having a low corrosion electric potential is facilitated. Since molybdenum has an effect of insulating hetero-metal, the galvanic corrosion may be reduced.

When the welding of the first welding layer 126*a* is completed, the second welding layer 126*b* that is main welding is formed on an upper surface of the first welding layer 126*a*. For example, STS316L stainless steel may be used as the second welding layer 126*b*. The STS316L stainless steel is ultralow carbon steel exhibiting superior anti-corrosion and anti-acid and high temperature strength. In particular, the STS316L stainless steel is appropriate as a material for the independent sliding pad 123 that rotates under seawater.

When the welding of the second welding layer 126*b* is completed, the contact surface of the independent sliding pad 123 with the lower bearing 122 is completed with the surfaces of the slit plates 125 and the second welding layer 126*b* formed between the slit plates 125 and in the slit 125*a*.

When a sliding contact surface is formed as above, most contacts between the lower bearing 122 and the independent sliding pad 123 are made on the slit plates 125. Since a smooth contact surface may be formed compared to the conventional sliding contact surface that is formed of numerous Inconel welding beads, sliding of the hull 2 around the turret device 10 as an axis may be very smoothly performed.

When the coupling of the slit plates 125 by welding is completed, a grinding work is performed as a finish work to remove the second welding layer 126*b* protruding above the surface of the slit plates 125. Since the stainless steel that is a material softer than Inconel is used, the grinding work according to the present embodiment is easily performed, an area needed for grinding is much reduced, and a work time is reduced, compared to a conventional grinding work performed after the Inconel welding.

As described above, the turret device 10 according to the present embodiment includes the upper bearing assembly (112 and 113) and the lower bearing assembly (122 and 123) that moors the vessel 1 to allow the hull 2 to rotate around the turret device 10 as an axis and also support the axial load and the horizontal load applied to the turret device 10. In particular, the lower bearing assembly (122 and 123) includes the independent sliding pad 123 that may be manufactured within a remarkably short work time compared to the conventional bearing structure and thus production efficiency of the turret device 10 may be improved.

While this invention has been particularly shown and described with reference to exemplary embodiments thereof, it will be understood by those skilled in the art that various changes in form and details may be made therein without departing from the spirit and scope of the invention as defined by the appended claims.

INDUSTRIAL APPLICABILITY

The present invention relates to a turret device installed in a vertical opening of a vessel to moor the vessel to allow the vessel to relatively rotate and may be used for a marine vessel.

The invention claimed is:

1. A turret device comprising:

an upper turret installed in a vertical opening that penetrates a hull; and a lower turret coupled to a lower portion of the upper turret and having a lower bearing assembly that supports the hull to allow rotation, wherein the lower bearing assembly comprises:

a lower bearing provided on an outer circumferential surface of the lower turret; and an independent sliding pad coupled to an inner wall of the hull forming the vertical opening and slidably contacting the lower bearing, wherein the independent sliding pad comprises a plurality of slit plates and each of the plurality of slit plates includes at least one slit.

2. The turret device of claim 1, wherein the independent sliding pad further comprises a bearing contact wall portion that protrudes from the inner wall of the hull forming the vertical opening.

3. The turret device of claim 2, wherein the plurality of slit plates are manufactured of a material different from a material for the bearing contact wall portion.

4. The turret device of claim 2, wherein a welding portion for combining the bearing contact wall portion and the plurality of slit plates is formed along edges of the plurality of slit plates and in the slit.

5. The turret device of claim 4, wherein the welding portion comprises:

a first welding layer preventing galvanic corrosion due to hetero-metal contact between the bearing contact wall portion and the plurality of slit plates; and a second welding layer formed on an upper surface of the first welding layer and preventing corrosion by seawater.

6. The turret device of claim 5, wherein the first welding layer is formed of molybdenum-added stainless steel and the second welding layer is formed of a stainless steel material.

7. The turret device of claim 1, wherein the lower turret is connected to the upper turret and expands toward a lower portion of the lower turret so as to have a diameter larger than a diameter of the upper turret.

8. The turret device of claim 1, wherein the lower turret is connected to the upper turret and expands toward a lower portion of the lower turret so as to have a diameter larger than a diameter of the upper turret.

9. The turret device of claim 2, wherein the lower turret is connected to the upper turret and expands toward a lower portion of the lower turret so as to have a diameter larger than a diameter of the upper turret.

* * * * *